United States Patent [19]

Cleveland

[11] 4,184,348

[45] Jan. 22, 1980

[54] APPARATUS FOR RANDOMLY COLORING TEXTILE YARNS IN A BATCH SYSTEM

[76] Inventor: J. B. Cleveland, P.O. Box 875, Calhoun, Ga. 30701

[21] Appl. No.: 908,132

[22] Filed: May 22, 1978

Related U.S. Application Data

[62] Division of Ser. No. 846,988, Oct. 31, 1977.

[51] Int. Cl.[2] ..... D06B 5/18

[52] U.S. Cl. ..... 68/188

[58] Field of Search ..... 8/14, 155.2, 158; 68/188, 206

[56] References Cited

U.S. PATENT DOCUMENTS

| | | | |
|---|---|---|---|
| 1,844,908 | 2/1932 | Skitt | 68/206 |
| 3,159,992 | 12/1964 | Helliwell | 68/206 |
| 3,541,635 | 11/1970 | Crenshaw et al. | 68/206 X |

*Primary Examiner*—Philip R. Coe

*Attorney, Agent, or Firm*—Cameron, Kerkam, Sutton, Stowell & Stowell

[57] ABSTRACT

Randomly dyed skeins of yarn are produced in an apparatus which comprises an open vat adapted to be filled with a liquid dye bath and having rack means for supporting a plurality of skeins of yarn which are to be randomly dyed. The rack means includes valved conduits to control the flow of dye therethrough. Further valve means are provided for selectively adjusting the level of the liquid dye bath relative to the skeins supported in the dye bath while maintaining the liquor ratio, i.e., the ratio of liquid dye bath to yarn dyed, constant and as low as practical.

10 Claims, 9 Drawing Figures

FIG. 5.
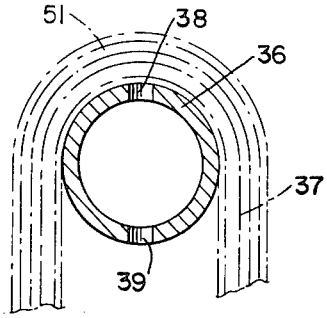
FIG. 6.
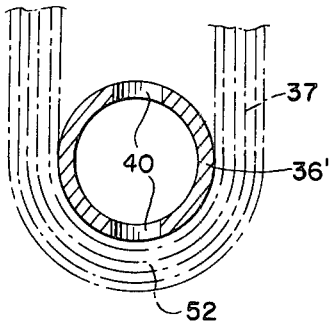
FIG. 7.
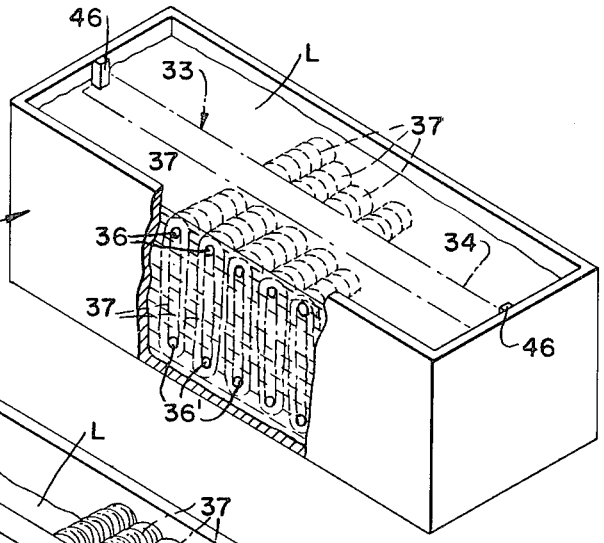
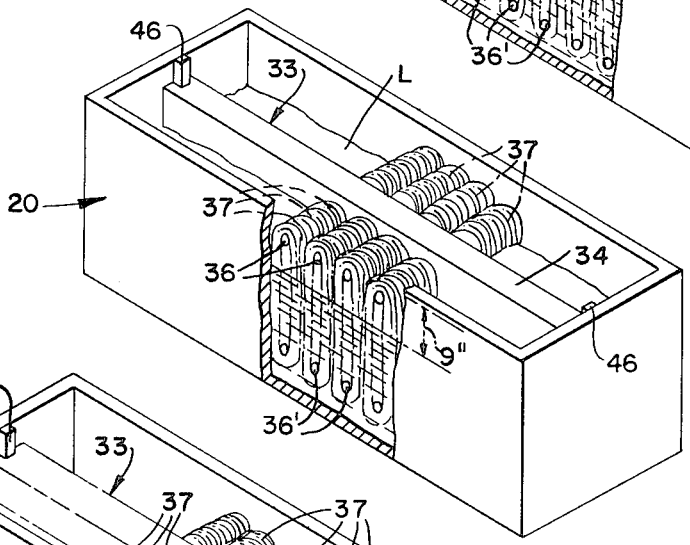
FIG. 8.
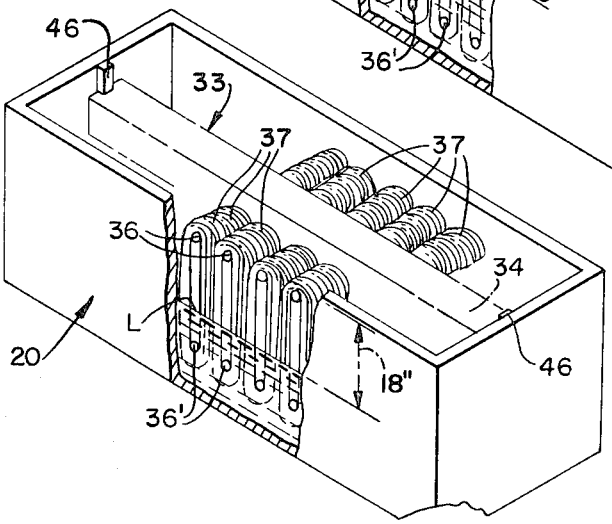
FIG. 9.

APPARATUS FOR RANDOMLY COLORING TEXTILE YARNS IN A BATCH SYSTEM

This is a division, of application Ser. No. 846,988, filed Oct. 31, 1977.

BACKGROUND OF THE INVENTION

This invention relates to an apparatus for dyeing yarn and is more particularly concerned with an apparatus for dyeing yarn with different colors or tones by means of application of dye colors to skein yarn packages.

Styling trends play an important role in the textile industry. Much emphasis has been placed of late on finishing a carpet in such a way that, although a single color remains the predominant base tone, a liveliness or an optically improved effect is obtained by dissolving the single color within a blend of yarns to achieve differing or variegated tones. In such carpets, the appearance of the surface does not have regularly recurring designs or patterns, nor does the carpet styling take on a geometrically defined outline. Rather, the carpet has a certain unified styling effect which, despite the randomness of color, is pleasant to the eye.

There are currently at least four commercial systems being used to space dye yarns used to fabricate multicolor carpets. These four systems may be divided into two basic classifications known as continuous systems and batch systems.

One of the two continuous systems used in the textile industry is the knit-de-knit space dyeing process which is generally described in U.S. Pat. No. 3,012,303, issued Dec. 12, 1961, to Ralph Whitaker. This process consists of six basic steps. The yarn is first knitted into a fabric after which a stripe or other pattern is printed on the knitted fabric. The color is set by steam color fixation of the knitted fabric which is then scoured to remove gums and excess dyes. After the knitted fabric is dried, the final step includes de-knitting of the knitted fabric to a cone of yarn.

The other of the continuous systems is generally known as warp printing. It also involves six basic steps including preparation of warp sheets (creeling) and thereafter application of a stripe or pattern which is printed on the warp sheet. The color is set by steam color fixation of the warp sheet which is then scoured to remove gums and excess dyes. After the warp sheet is dried, it is split and the yarns rewound onto cones.

Both types of the continuous systems suffer from similar disadvantages in that they require high levels of water consumption and expensive water treatment to remove pollutants. Costs of operation are high due to wasted energy in atmospheric steaming, continuous drying and high labor requirements.

The two batch systems in commercial use are injection dyeing and skein dyeing. Injection dyeing processes have been known for over a half of a century. Still, injection dyeing accounts for only a small portion of the textile yarn being dyed into multicolors. A typical process for injection dyeing is described in U.S. Pat. No. 1,726,984 to Louis Hasbrouck, dated Sept. 3, 1929. Another injecting dyeing process is disclosed in U.S. Pat. No. 3,120,422, dated Feb. 4, 1964. Both of these patents cover dyeing of one cone at a time with the use of hypodermic needles inserted into the cone of yarn to apply the dyes. As hereinbefore noted, injection dyeing processes have not found a great deal of commercial acceptance.

In the other of the batch systems used in the textile industry, the yarn is first unwound from its cones or bobbins to skeins which are loaded into the vat of a dye machine. The skeins are totally submerged in a dye bath and a base color is applied. The skeins are then partially raised out of the dye bath, and may further be rotated depending on the design of the machine and a second color is applied to the portion of the yarn submerged in the dye bath. This step is repeated for each additional color desired, after which the skeins are removed from the dye machine and put into a centrifugal extractor to remove the excess water. The skeins are then dried in an oven drier after which the skein dyed yarn is rewound on cones for further processing.

A typical apparatus for space dyeing of skeins by total submersion and application of a base color and thereafter selective withdrawal or raising of the skeins to apply additional colors to the partially immersed yarn was placed in commercial production in late 1971 by James H. Eakes and is described and illustrated in his application Ser. No. 480,026, filed June 17, 1974, now abandoned. Such apparatus for producing space dyed skeins of yarns is also described and illustrated in O'Mahoney et al. U.S. Pat. No. 3,926,547 and 3,986,375.

It will be readily apparent to those skilled in the art that the apparatus for affecting space dyeing of yarn as described in the aformentioned Eakes application Ser. No. 480,026 and O'Mahoney U.S. Pat. Nos. 3,926,547 and 3,986,375 are but variations of the open dye vat apparatus of the type shown in Butterworth Pat. No. 1,911,305 and Helliwell U.S. Pat. No. 3,159,992 for dyeing skeins a single solid color. In the Butterworth patent, there is disclosed the basic open vat system which includes a skein carrier having laterally extending yarn support arms which may be rotated to insure subjection of all parts of the yarn skeins to treating dye liquid. The Helliwell patent employs a controlled distribution of dye liquor from a central source which produces a uniform lifting and "floating" of the skeins of yarn to provide a homogeneous dyeing. While the Butterworth and Helliwell patents are concerned with solid or single color dyeing, the Eakes and O'Mahoney et al. methods and apparatus differ therefrom and achieve multicolor dyeing or space dyeing of yarns by use of a supercarrier or rack which is loaded with yarn and positioned above the internal skein carrier and dye tubes and selectively lifted and positioned between a fully lowered position in the dye bath and a plurality of raised positions.

Notwithstanding the fact that multicolor skein dyeing has experienced a certain degree of popularity due to the ability of yarn suppliers to provide materials which enable manufacturers of textile carpets to meet the demands for continuous changes in styling trends and ever-changing public tastes for color patterns which are out of the ordinary, little has been done to improve the efficiency of the batch operations of the type commercialized in 1971 by James H. Eakes and described in his aforementioned abandoned application Ser. No. 480,026 or that of U.S. Pat. Nos. 3,926,547 and 3,986,375 which suffer from many disadvantages.

For example, the supercarriers of such apparatus must be so constructed as to support the increased weight of yarns due to immersion. In each apparatus, a compromise is frequently reached by operation at less than full capacity of the machine to prevent bending of the cantilever yarn supporting tubes. Further, the apparatus is frequently subjected to hang-ups which interfere with production. To this end, the yarn after being immersed, expands or bulks out and because the yarn supported by the supercarrier must be withdrawn over the interior skein carrier and dye tubes, extraction is difficult. Another disadvantage is that the liquor ratio is not constant. That is, inasmuch as the entire vat is refilled each time a second dyestuff is added for each partial immersion of yarn, such a process also suffers from the disadvantage of high water consumption and high energy requirements needed to maintain operating temperatures of the liquid. Such batch operations require high liquor ratios which consume excessive quantities of dyestuffs and chemicals, thus increasing the cost of production. Accordingly, it is a principal object of the present invention to provide an improved apparatus for space dyeing of yarns by the batch process.

It is another principal object of the present invention to provide an improved apparatus for multicolor dyeing of skeins of yarn.

Another object of the present invention is to provide an improved apparatus for space dyeing of textile yarns which is highly efficient and highly economical in operation.

Many of these disadvantages are either overcome or minimized by the process and apparatus of the present invention wherein space dyeing of skeins of yarn is effected by adjusting the level of the liquid dye bath relative to the skeins while maintaining a constant liquor ratio and avoidance of the use of a supercarrier which must be selectively elevated. This enables an improved control of color reproduction from batch to batch.

Other features and advantages of the invention will become apparent to those skilled in the art upon a reading of the following description.

SUMMARY OF THE INVENTION

In accordance with the present invention there is provided a process and apparatus for randomly coloring textile yarns in a batch system. Undyed skeins of yarn are loaded into an open vat which is filled with a liquid dye bath. The level of the liquid dye bath is selectively adjusted relative to the skeins while maintaining a constant liquor ratio. Preferably, the level of the liquid dye bath is selectively dropped in fixed increments without removing the yarn from the vat. At each new level, additional dye materials are added to achieve the desired coloration.

To adjust the liquid dye bath level, there is provided a hank or skein supporting structure comprising upper and lower headers, each having hank supporting arms extending therefrom in cantilever fashion. The headers are coupled through a valved plenum which permits selective circulation of the dye bath through either one or both headers. The upper header is telescopingly supported to allow for variation in the distance apart between the yarn supporting arms about which the skeins are positioned. A suitable motor driven pump and conduit system is connected to an inlet in the plenum and the vat to effect circulation of the dye liquor, while a conveniently located sight tube enables the liquor level to be monitored. Lowering of the liquor level in the vat is effected by means of a drain valve, while appropriately disposed control valves may be operated to control circulation of the dye liquor through either the upper header, the lower header or both headers. The upper and lower supporting arms which extend laterally in parallel rows from each header and which are in communication with the associated header are provided with spaced openings through which the pumped dye liquor exits into the vat.

BRIEF DESCRIPTION OF THE DRAWINGS

FIG. 5 is an enlarged vertical section taken on line 5—5 of FIG. 4.

FIG. 6 is a similar section taken on line 6—6 of FIG. 4.

FIGS. 7, 8 and 9 are partly schematic perspective views of the apparatus depicting the incremental lowering of the liquid dye bath level in accordance with the process embodied in the invention.

DETAILED DESCRIPTION

Figure 1:
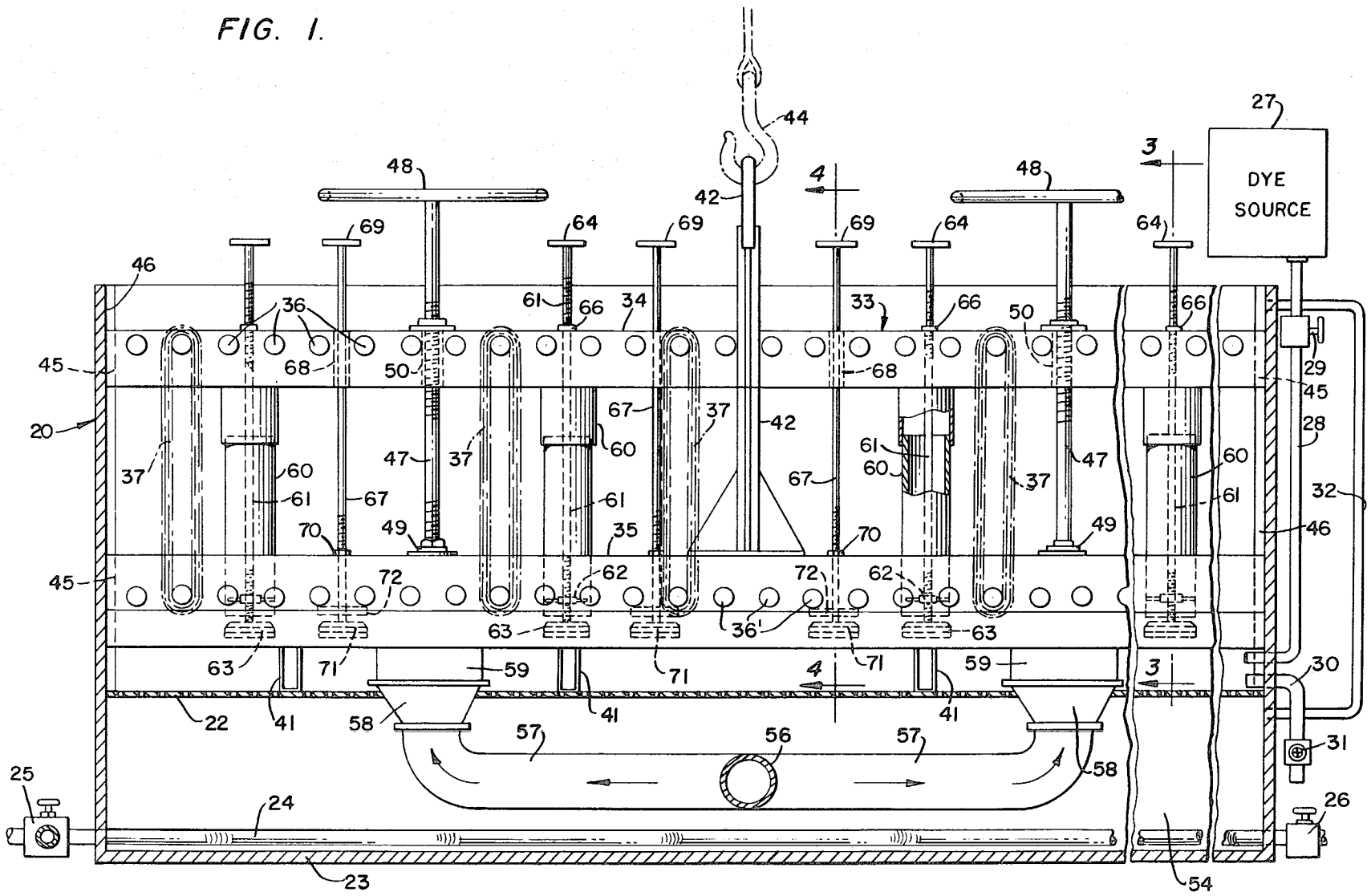
FIG. 1 is a longitudinal vertical section through an apparatus used in the practice of the method and embodying the invention, parts in elevation.

Referring to the drawings in detail, wherein like numerals designate like parts, the numeral 20 designates an open top rectangular dye vat adapted to receive a liquid dye bath at various levels L as indicated in FIGS. 7, 8 and 9. The vat has an apertured false bottom 22 at a fixed elevation above the vat bottom wall 23 through which the dye bath may circulate freely into the spaces above and below the false bottom.

A dye bath heating coil 24 of serpentine configuration is disposed close to the bottom wall 23 and receives steam at its upstream end through a suitable inlet valve 25 positioned outside of the vat 20. Preferably a steam outlet control valve 26 is provided in the downstream end of the coil 24 outside of the vat, as illustrated.

An elevated dye bowl 27 delivers dyestuff through a depending pipe 28 having a valve 29 into the vat near and above the false bottom 22 at one end of the vat. A vat drain conduit 30 having a control valve 31 is also connected in the same end wall of the vat 20 immediately above the false bottom 22 so that the level of the dye bath in the main chamber of the vat above the false bottom can be adjusted through a wide range according to a main feature of the invention. A liquid level sight gage 32 is also provided on the same end wall of the vat having the drain conduit 30 so that the level of the dye bath in the vat may be accurately monitored.

Figure 2:
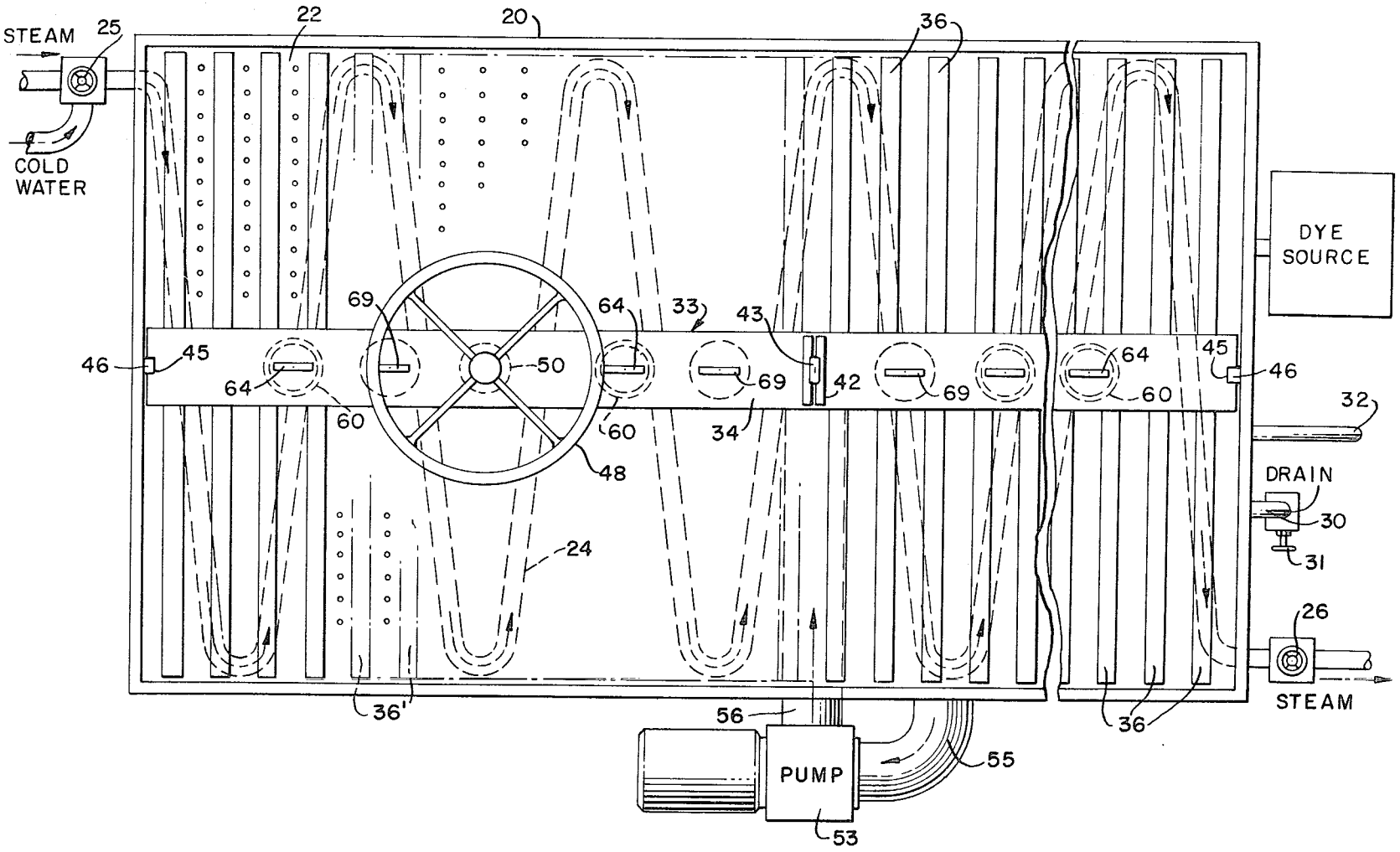
FIG. 2 is a fragmentary plan view of the apparatus.

A multiple yarn hank or skein support rack 33 formed as a unit for placement in the dye vat 20 comprises spaced upper and lower headers 34 and 35, each carrying on the opposite sides thereof a plurality of parallel horizontal equidistantly spaced cantilevered skein support arms or tubes 36 and 36'. As shown in FIG. 2, the outer ends of the arms 36 and 36' terminate in closely spaced relationship to the vat side walls and thus span substantially the entire width of the vat with the endmost support arms arranged near the vat end walls so that substantially the entire length and width of the vat can be utilized efficiently to receive a maximum number of yarn skeins 37. The upper skein support arms 36 which lie in a common horizontal plane are cylindrical, FIG. 5, and are provided in their tops and throughout substantially their entire lengths with continuous longitudinal slots 38 and are provided in their bottoms diametrically opposite the slots 38 with multiple equidistantly spaced apertures 39. Similarly, the lower skein support arms 36' which are also cylindrical, FIG. 6, are provided in their tops and bottoms with multiple equidistantly spaced apertures 40 preferably of a larger size than the apertures 39.

The skein support rack 33 further comprises suitably spaced transverse support feet 41 rigidly attached to the bottom of lower header 35 and adapted to rest on the false bottom 22 to support the rack 33 removably in the upper main chamber of the vat. For lifting the rack 33 bodily when it is placed in the vat, as in FIG. 1, or removed therefrom, a centered lifting post 42 rigidly joined with the upper and lower headers 34 and 35 extends above the top of the vat and has a top lifting lug 43 adapted for connection with a lifting hook 44 of a hoist. For proper guidance of the rack 33 into and out of the vat 20, the opposite ends of the headers 34 and 35 have guide grooves 45 formed therein engageable with vertical guide ribs 46 on the end walls of the vat at the transverse center thereof.

The upper and lower headers 34 and 35 are interconnected adjustably by longitudinally spaced vertical screw shafts 47 having top hand wheels 48 above the vat 20, the lower ends of the screw shafts 47 being swiveled at 49 to the lower header 35, and the screw shafts having threaded connections with sleeve nuts 50 in the upper header 34. By virtue of this arrangement, when the hand wheels 48 are turned to rotate the screw shafts 47, the upper header 34 can be adjusted vertically upwardly or downwardly relative to the lower header 35. When the skeins 37 are being placed on the support arms 36 and 36', the upper header 34 is adjusted downwardly to allow easy placement of the skeins in an unstretched condition over pairs of the arms 36 and 36'. When all of the skeins are mounted on the support arms, the upper header 34 is raised somewhat by operation of the screw shafts 47 to place sufficient tension on the skeins to prevent displacement thereof on the support arms during manipulation of the rack 33. The screw shafts 47 serve the additional purpose of tying the two headers 34 and 35 of the rack 33 together in a unit assembly.

Referring to FIGS. 5 and 6, it may be seen that when the skeins 37 are loaded on the support arms 36 and 36' of the rack, their top and bottom bights 51 and 52 which are necessarily under some compression due to the adjustment of the upper header 34 are arranged to receive dye liquor under pressure from the slots 38 and lower apertures 40, respectively, to assure complete impregnation of the bight portions of the skeins at the two pressure points where they pass over and under the support arms 36 and 36'. The continuous slots 38 of the upper support arms deliver pressurized streams of dye liquor against the bights 51 so that the upper bights float on the support arms 36 to some extent during the operation of the apparatus to further insure full impregnation of the yarn skeins in the regions which are looped over the support arms 36. Gravity assists in this operation at the bottom bights 52 of the skeins where they are looped under the lower support arms 36'.

A very important aspect of the apparatus essential to the practice of the method is the provision therein of a valved dye bath circulating system enabling selective circulation of the bath through either one of, or both, of the headers 34 and 35. This valved circulating system or means comprises a motor driven circulating pump 53 external to the vat 20 and adapted to continuously draw the dye bath from the lower chamber 54 of the vat through an elbow conduit 55 connected with the vat and pump. The liquid thus drawn into the pump is delivered by the pump through a delivery conduit 56 to communicating branch conduits 57 in the lower chamber 54 which are coupled into lower plenum sections 58 fixed in the false bottom 22 directly beneath the lower header 35. Mating depending plenum sections 59 carried by the lower header 35 are adapted to register in sealed relationship with the mouths of the plenum sections 58 when the rack 33 is placed in the vat and comes to rest on the false bottom 22. The plenum sections 59 communicate directly with the interior of the lower header 35 through bottom openings therein.

Figure 3:
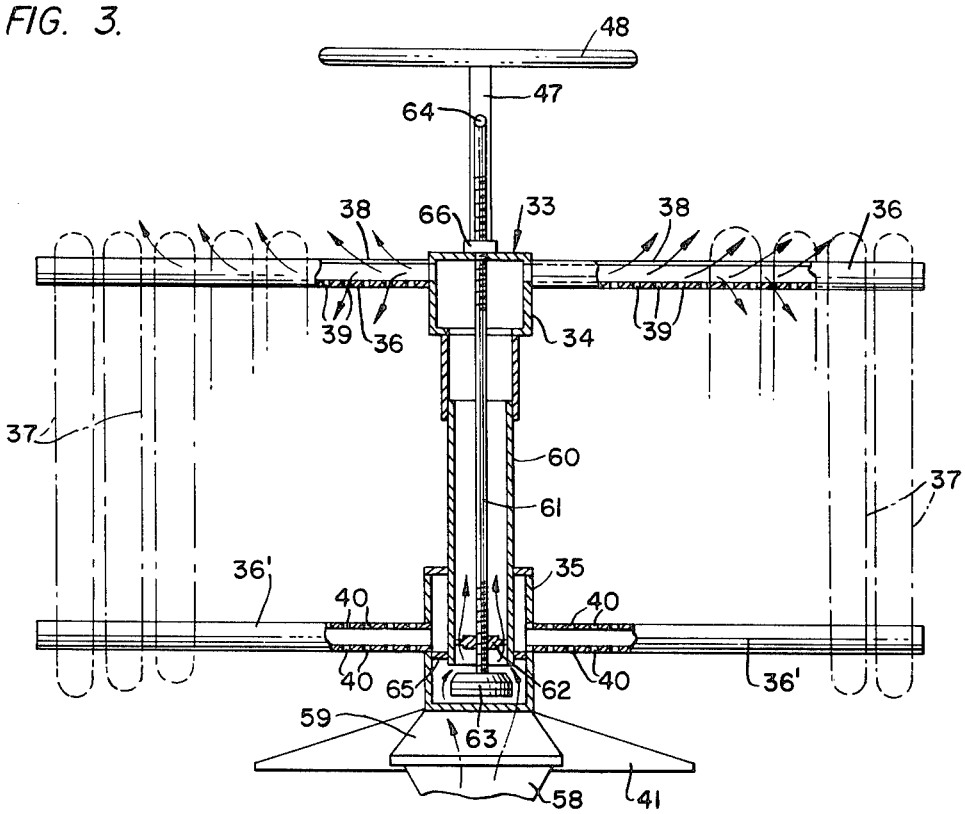
FIG. 3 is a transverse vertical section taken on line 3—3 of FIG. 1.

The upper and lower headers 34 and 35 are in fluid communication at a plurality of spaced points therealong by means of valved telescopic vertical plenum tubes 60 whose upper telescoping sections are connected in the bottom of the upper header 34 as shown in FIG. 3 and whose lower sections are connected into the top wall of the lower header 35, as shown.

Each telescoping plenum tube 60 receives therethrough axially a rotary screw-threaded valve stem 61 having threaded engagement with a fixed spider 62 in the lower end portion of the plenum tube 60 which terminates within the lower header 35, FIG. 3, slightly below the level of the lower skein support arms 36'. The lower end of each stem 61 carries a valve head 63 adapted to seat against and close the lower end of the plenum tube 60 at proper times and to uncover or open such lower end at proper times as illustrated in FIG. 3. Each threaded stem 61 is equipped with a turning handle 64 above the upper header 34 and preferably above the open top of the dye vat 20. A fixed web 65 within the lower header 35 and immediately below the tubular support arms 36' which communicate with the lower header blocks the passage of dye liquor from plenum sections 59 into the lower arms 36' around the plenum tubes 60 and directs the pressurized liquid into and upwardly through the tubes 60 when the valve heads 63 are open as shown by the directional arrows in FIG. 3. The valve stems 61 also intersect and pass through the upper header 34 and have swiveled connections therewith as at 66. The above-described arrangement shown in detail in FIG. 3 enables the dye bath to be pumped at required times during the practice of the method into the upper header 34 and through the upper support arms 36 to the tops of the skeins 37. At other required times, the valve heads 36 may be closed against the bottoms of the plenum tubes 60 to prevent the passage of the dye bath into the upper header and arms 36.

Figure 4:
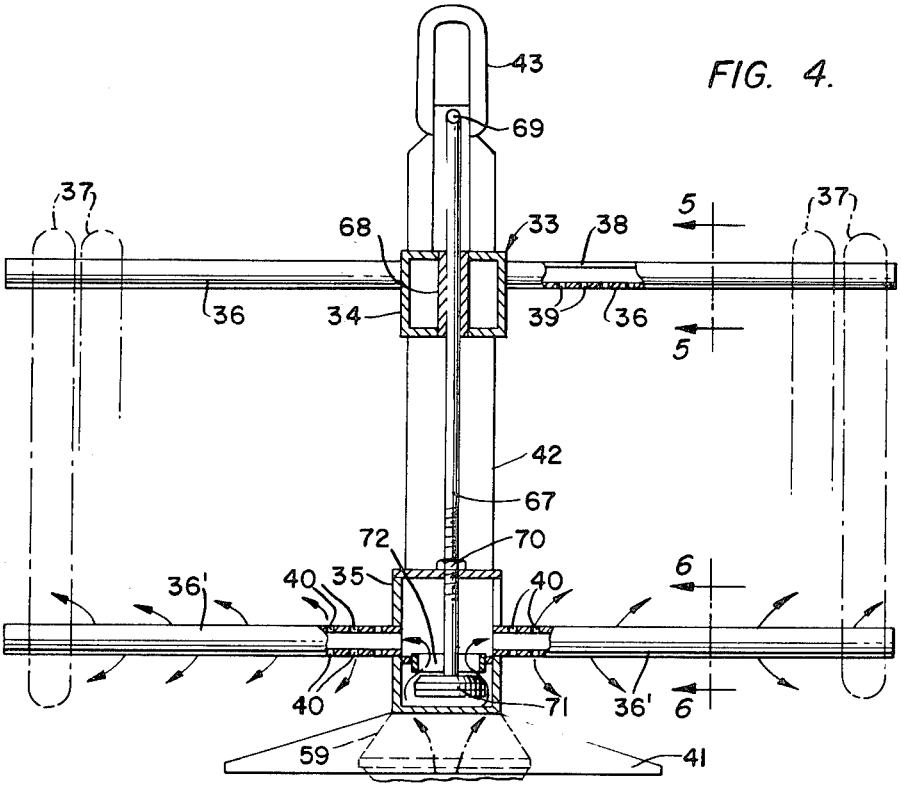
FIG. 4 is a similar section taken on line 4—4 of FIG. 1.

Additional valving is provided in the apparatus, FIGS. 1 and 4, to selectively control the admission of dye liquor into the lever header 35 independently of the described valve means for the upper header 34 shown in FIG. 3, whereby the dye bath can be circulated through both headers and both banks of skein support arms 36 and 36' or through either one of the headers and associated banks of support arms selectively as need dictates in the practice of the method. The valving for the lower header 35 comprises vertical screw-threaded rotary valve stems 67, FIG. 4, intervened with the valve stems 61 along the length of the vat 20.The stems 67 extend through and have swiveled engagement at 68 with the upper header 34 and are equipped at their tops with turning handles 69. Referring to FIG. 4, the rotary stems 67 have screw-threaded engagement at 70 with the lower headers 35 and extend into the lower headers and carry valve heads 71 at their lower ends within the lower headers. These valve heads 71 are adapted to engage ring seats 72 fixed within the lower header to selectively admit dye liquor through the ring seats 72 into the lower header and lower skein support arms 36' or block such dye liquor flow to the support arms 36' as the need dictates.

Thus, when the adjustable valve heads 63 and 71 are all open as shown in FIGS. 3 and 4, dye liquor from the pump 35 is delivered simultaneously to both the lower and upper headers 35 and 34 and to both banks of skein support arms 36' and 36, as when the dye bath level L is at the maximum point in FIG. 7 above the tops of the skeins 37. When the valve heads 63 are all closed, while the heads 71 remain open, the flow of dye liquor from the pump to the upper header 34 and arms 36 is blocked, while the liquor can still flow freely from the pump to the lower header and into the lower support arms 36'. The significance of this selectively operable valving in the apparatus will be further apparent in the following description of the method with particular reference to drawing FIGS. 7 through 9.

THE METHOD

When it is desired to randomly or space dye carpet yarns or the like in accordance with the method, the multiple skeins 37 of yarn are loaded onto the support arms 36 and 36' of the rack 33 with the rack outside of the vat 20 in the already-described manner including the necessary height adjustments of the upper header 34 by means of the screw shafts 47. The rack 33 loaded with the skeins 37 can then be lowered as a unit into the dye vat 20.

Following this, the vat is filled with water at 100° F. up to the maximum level L shown in FIG. 7, which is above the tops of the skeins 37 and the latter are completely immersed in liquid. Chemicals and well-dissolved dyestuff from the bowl 27 according to a first formulation are now introduced into the vat 20 to establish a desired liquor ratio which is maintained constant throughout the process. An example of the first dye and chemical formulation used to impart a desired base color to all of the skeins 37 in the first stage of the batch dyeing process is the following, it being understood that the percentages shown in the formulation are percentage by weight of the yarn being randomly dyed in the process:

FORMULA I: (33%) 0.35% NYLANTHRENE YELLOW (ACID YELLOW 40)
0.35% TELON BLUE 2GL (ACID BLUE 40)
Chemicals:
1.0% AMMONIA
1.0% CHEMCOGEN 6DL (CPG-RETARDING AGENT).
1.00% CHEMCOLOX 200 (CPG-SEQUESTRENE AGENT).

After introduction of the first formulation into the vat, the bath is heated to 200° F. and circulated by means of the pump 53 for fifteen minutes while all of the valve heads 63 and 71 are open. As previously-explained, the resulting forced circulation of the dye bath simultaneously through both headers 34 and 35 and both banks of support arms 36 and 36' will force the liquid through the bights 51 and 52 of the skeins in the regions of engagement with the support arms, to assure complete and uniform coloring of the skeins to a desired base color or shade. If the shade thus imparted to the skeins is satisfactory, this completes the first stage of the process.

To begin the second stage of the process, the valve heads 63 are closed to completely block the passage of liquid to the upper headers 34 and support arms 36. The valve heads 71 remain open so that the dyeing liquid circulated by the pump 53 can enter the lower header 35 and lower skein support arms 36'. By opening the drain valve 31, the level L of the dye bath in the vat 20 is lowered to a desired new level as shown in FIG. 8 where top portions of the skeins 37 already dyed in a basic color are now above the dye bath with the remainders of the skeins submerged in the bath. Formula II of dye and chemicals is now added to the vat and an example of this formulation is as follows:

FORMULA II: (33%)
0.20% NYLANTHRENE YELLOW B4RK (ACID YELLOW 40)
0.036% TELON BLUE 2GL
(ACID BLUE 40)
Chemicals:
2.0% AMMONIUM SULPHATE.

Following the addition of Formula II to the vat, the dye bath is circulated by the pump for thirty minutes at 200° F. and this imparts to the submerged portions of the skeins 37, FIG. 8, the desired second color or shade, the unsubmerged portions of the skeins above the level L in FIG. 8 retaining the initially applied base color. This completes the second stage of the process.

To begin the third and final stage of the space dyeing batch process, the liquid level L in the vat is again lowered to a desired new level, FIG. 9, and Formula III, below, is added:

FORMULA III: (33%)
0.04% TELON BLUE 2GL (ACID BLUE 40)
No Chemicals.

The valve heads 71 remain open and the valve heads 63 remain closed, as with the second stage. The dye bath is again circulated for thirty minutes at 200° F. and this imparts a third color zone to the skeins 37 at their lower end portions, FIG. 9, so that the skeins now have three distinct color regions. This completes the third stage of the process.

The dye bath is now completely drained from the vat through the drain pipe 30 and the vat is filled with cold water which is circulated for approximately ten minutes to rinse the skeins and, following this rinsing, the rack 33 is pulled from the vat 20 so that the skeins which have now been spaced dyed can be further processed in accordance with conventional practice.

While a three-stage space dyeing batch process has been described with three dye formulations, it should be understood that the invention is not limited to any particular number of stages and any particular formulations and the disclosed three-stage process and three formulations are illustrative only of many variations which are possible under the invention. The space dyeing may, for example, involve four or more stages with four or more liquid levels and four or more dye formulations in lieu of the three which have been described.

It should now be apparent that, in comparison to the prior art, the invention effects a considerable saving of water, dyestuff and energy. In the prior art evidenced by U.S. Pat. No. 3,986,375, O'Mahoney et al., as the supporting rack for skeins is successively elevated to new levels, a full dye vat containing a fresh charge of dyestuff and chemicals is required at each stage of the space dyeing process. In the present invention, FIGS. 8 and 9, only a partial and decreasing volume of dye bath liquid, dyestuff and chemicals is required for each successive stage of the process and furthermore the liquor ratio (ratio of liquid dye bath to yarn dyed) can remain constant and as low as practical since, at each stage of the process, a lesser mass of yarn is being dyed and lesser amounts of liquid, dyestuff and chemicals are needed.

Another main virtue of the invention is that the rack 33 can be loaded to full capacity with skeins (compared to the prior art practice of partial loading) as there is no necessity for repeatedly raising and lowering the rack during the process as only the level L of the dye bath in the vat is adjusted. The many advantages of the invention over the prior art should now be recognized by those skilled in the art without the necessity for further description herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. Apparatus for dyeing yarn comprising an open vat, yarn skein supporting means comprising upper and lower headers, each header having skein supporting arms extending therefrom in cantilevered relation thereto, valved plenum means including telescoping plenum tubes extending between said upper and lower headers and coupling said headers for selective circulation of a dye bath through one or both of said headers, said upper header being movably supported relative to the lower header to allow for variation in the spacing between the skein supporting arms of the upper and lower headers, selectively operable dye bath flow control valves in the plenum means for regulating the admission of the dye bath to both of said headers simultaneously or to one header only, said flow control valves comprising two independent sets of valves in the plenum means, one set regulating the flow of the dye bath to the upper header through said telescoping plenum tubes and the other set of valves regulating the flow of the dye bath from the plenum means into the lower header, and pump and conduit means connected to an inlet of said plenum means and to the vat to effect circulation of the dye bath.

2. Apparatus for dyeing yarn as set forth in claim 1, and the skein supporting arms extending from the upper header being longitudinally slotted through their tops and having spaced apertures in their bottoms, the skein supporting arms of the lower header having longitudinally spaced apertures in their tops and bottoms.

3. Apparatus for dyeing yarn as set forth in claim 1, and a valved drain conduit on said vat through which the dye bath level in the vat can be incrementally lowered, and a sight gage on the vat to allow visual monitoring of the dye bath level.

4. Apparatus for dyeing yarn comprising an open vat, yarn skein supporting means comprising upper and lower headers, each header having skein supporting arms extending therefrom in cantilevered relation thereto, valved plenum means coupling said headers for selective circulation of a dye bath through one or both of said headers, said upper header being movably supported relative to the lower header to allow for variation in the spacing between the skein supporting arms of the upper and lower headers, means connected with said headers and operable to adjust the space between the headers and to lock them in selected adjusted positions and the valves of the valved plenum means including adjustable valve sets bodily mounted on said headers with said adjusting means for the headers and forming therewith a skein supporting rack unit which is bodily placeable in and removable from said vat, and cooperating guide means on the headers and vat for guiding the rack unit into and out of the vat and pump and conduit means connected to an inlet of said plenum means and to the vat to effect circulation of the dye bath.

5. Apparatus for dyeing yarn is set forth in claim 4, and further including a lifting and lowering support member on said rack unit centrally thereof and said valved plenum means including telescoping plenum tubes extending between the upper and lower header, said plenum means having selectively operable dye bath flow control valves for regulating the admission of the dye bath to said headers, said flow control valves comprising two independent sets of valves in the plenum means, one set regulating the flow of the dye bath to the upper header through said telescoping plenum tubes and the other set of valves regulating the flow of the dye bath from the plenum means into the lower header.

6. Apparatus for dyeing yarn comprising on open vat, yarn skein supporting means comprising upper and lower headers, each header having arms extending therefrom in cantilevered relation thereto and in communication with the interior thereof, valved plenum means including telescoping plenum tubes extending between the upper and lower header coupling said headers for selectively circulating a dye bath through one or both of said headers and the associated arms, and pump and conduit means connected to an inlet of said valved plenum means and to the vat to effect circulation of the dye bath and selectively operable dye bath flow control valves in the plenum means for selectively regulating the admission of the dye bath to said headers, said flow control valves comprising two independent sets of valves in the plenum means, one set regulating the flow of the dye bath to the upper header through said telescoping plenum tubes and the other set of valves regulating the flow of the dye bath from the plenum means into the lower header.

7. Apparatus for dyeing yarn as set forth in claim 6, wherein the arms extending from the upper header are longitudinally slotted through their tops and include spaced apertures in their bottoms and the arms of the lower header having longitudinally spaced apertures in their tops and bottoms.

8. Apparatus for dyeing yarn as set forth in claim 6 further including a valved drain conduit on said vat through which the dye bath level in the vat can be incrementally lowered, and a sight gage on the vat to allow visual monitoring of the dye bath level.

9. Apparatus for dyeing yarn as set forth in claim 8 and further including means connected with said headers and operable to adjust the space between the headers and to lock them in selected adjusted positions.

10. Apparatus for dyeing yarn as set forth in claim 4 wherein the valves of the valved plenum means including adjustable valve sets bodily mounted on said headers with said adjust means for the headers and forming therewith a skein supporting rack unit which is bodily placeable in and removable from said vat, and cooperating guide means of the headers and vat for guiding the rack unit into and out of the vat.

* * * * *